US010837128B2

(12) United States Patent
Griesshammer et al.

(10) Patent No.: US 10,837,128 B2
(45) Date of Patent: Nov. 17, 2020

(54) METHOD FOR PROCESSING A STRAND-SHAPED FIBER SLIVER, AND ROVING FRAME MACHINE

(71) Applicant: Maschinenfabrik Rieter AG, Winterthur (CH)

(72) Inventors: Christian Griesshammer, Winterthur (CH); Petr Haska, Ceska Trebova (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 51 days.

(21) Appl. No.: 16/316,780

(22) PCT Filed: Jun. 27, 2017

(86) PCT No.: PCT/IB2017/053823
§ 371 (c)(1),
(2) Date: Jan. 10, 2019

(87) PCT Pub. No.: WO2018/011655
PCT Pub. Date: Jan. 18, 2018

(65) Prior Publication Data

US 2020/0181810 A1 Jun. 11, 2020

(30) Foreign Application Priority Data

Jul. 14, 2016 (CH) ..... 893/16

(51) Int. Cl.
*D01H 1/115* (2006.01)
*B65H 51/20* (2006.01)
(Continued)

(52) U.S. Cl.
CPC ..... *D01H 1/115* (2013.01); *B65H 51/20* (2013.01); *B65H 54/76* (2013.01); *B65H 54/88* (2013.01)

(58) Field of Classification Search
CPC . D01H 1/115; D01H 1/11; D01H 1/00; D01H 1/20; D01H 1/24; D01H 1/241;
(Continued)

(56) References Cited

U.S. PATENT DOCUMENTS 3,902,308 A * 9/1975 Bernstein ..... D01H 13/145 57/265
4,685,283 A * 8/1987 Slavik ..... B65H 54/26 242/473.6
(Continued)

FOREIGN PATENT DOCUMENTS

CH 221 905 A 6/1942
DE 29 34 830 A1 3/1981
(Continued)

OTHER PUBLICATIONS

CH Search Report, dated Oct. 12, 2016.
PCT Search Report, dated Oct. 16, 2017.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A method for processing a strand-type fiber bundle includes sending the fiber bundle to an air nozzle of a pre-spinning machine used to produce roving. A twist is imparted to the fiber bundle via a vortex air current within the air nozzle to form the roving, wherein the roving leaves the air nozzle through an outlet and is deposited in a receptacle. Normal operation is interrupted in a stop phases during which roving is not produced by the air nozzle. A start-up phase is commenced between the stop phase and subsequent normal operation wherein the roving produced during the stop phase is discarded after leaving the air nozzle when quality of the roving does not meet a desired specification. The roving discharge is deactivated when the quality of the roving meets
(Continued)

the desired specification and the roving removed by the roving discharge is separated from the roving.

12 Claims, 3 Drawing Sheets

(51) Int. Cl.
*B65H 54/76* (2006.01)
*B65H 54/88* (2006.01)

(58) Field of Classification Search
CPC ..... D01H 1/242; D01H 1/243; D01H 1/244; B65H 54/76; B65H 51/20; B65H 54/88
See application file for complete search history.

(56) References Cited

U.S. PATENT DOCUMENTS 5,272,864 A * 12/1993 Suzuki ..... D01H 9/10 57/264
5,285,624 A * 2/1994 Stahlecker ..... D01H 13/04 57/328
5,511,373 A * 4/1996 Banba ..... D01H 1/115 57/328
5,704,204 A * 1/1998 Mima ..... D01H 15/002 57/280
5,813,209 A * 9/1998 Hirao ..... D01H 15/002 57/261
5,934,058 A * 8/1999 Hirao ..... D01H 15/002 57/261
6,499,194 B1 * 12/2002 Gresser ..... D01H 5/42 19/239
7,464,529 B2 * 12/2008 Stahlecker ..... D01H 1/115 57/263
8,904,742 B2 * 12/2014 Stephan ..... D01H 4/02 57/263
10,400,363 B2 * 9/2019 Pilar ..... D01H 13/16
2002/0026781 A1 * 3/2002 Shigeyama ..... D01H 4/02 57/12
2002/0056265 A1 * 5/2002 Nakayama ..... D01H 1/115 57/261
2002/0124543 A1 * 9/2002 Bischofberger ..... D01H 4/38 57/5
2002/0144496 A1 * 10/2002 Anderegg ..... D01H 4/02 57/261
2003/0131579 A1 * 7/2003 Feuerlohn ..... D01H 15/002 57/328
2004/0221567 A1 * 11/2004 Stahlecker ..... D01H 4/02 57/281
2006/0096271 A1 * 5/2006 Yamamoto ..... D01H 1/115 57/350
2008/0066442 A1 * 3/2008 Stahlecker ..... D01H 4/02 57/261
2009/0044510 A1 * 2/2009 Sawada ..... D01H 1/115 57/6
2009/0094958 A1 * 4/2009 Weide ..... D01H 15/002 57/263
2013/0067878 A1 * 3/2013 Stephan ..... D01H 1/24 57/78
2013/0067880 A1 * 3/2013 Stephan ..... D01H 4/50 57/80
2013/0333347 A1 * 12/2013 Stephan ..... D01H 4/50 57/263
2014/0208711 A1 * 7/2014 Griesshammer ..... D01H 4/48 57/333
2014/0223881 A1 * 8/2014 Gotz ..... D01H 7/92 57/403
2014/0237985 A1 * 8/2014 Schaffler ..... D01H 4/02 57/350
2014/0283496 A1 * 9/2014 Stahlecker ..... B65H 67/081 57/263
2014/0366503 A1 * 12/2014 Griesshammer ..... D01H 1/115 57/350
2015/0240393 A1 * 8/2015 Haska ..... D01H 7/92 57/333
2015/0240394 A1 * 8/2015 Blankenhorn ..... D01H 1/115 57/333
2015/0283746 A1 * 10/2015 Schaffler ..... B29C 48/05 425/319
2015/0283747 A1 * 10/2015 Hofmann ..... B29C 48/05 425/319
2015/0284878 A1 * 10/2015 Kubler ..... D01D 5/06 425/461
2015/0329994 A1 * 11/2015 Schaffler ..... D01H 4/34 57/410
2015/0361592 A1 * 12/2015 Schaffler ..... D01H 13/306 57/403
2015/0361594 A1 * 12/2015 Fischer ..... D01H 13/22 53/296
2016/0032498 A1 * 2/2016 Kubler; Markus ..... D01H 4/02 57/333
2017/0101287 A1 * 4/2017 Griesshammer ..... B65H 63/024
2017/0145601 A1 * 5/2017 Ricaurte-Rubio ..... D01H 1/115
2019/0136419 A1 * 5/2019 Blankenhorn ..... D01H 4/02
2019/0323151 A1 * 10/2019 Haska ..... D01H 7/92

FOREIGN PATENT DOCUMENTS

DE 30 34 812 A1 4/1981
DE 232 246 A1 1/1986
DE 102 41 011 A1 3/2004
DE 10 2012 102695 A1 10/2013
EP 0 174 112 A1 3/1986
EP 2 112 258 A2 10/2009
EP 2 511 403 A1 10/2012
GB 2 248 458 A 4/1992
WO WO 2015/181598 A1 12/2015

* cited by examiner

METHOD FOR PROCESSING A STRAND-SHAPED FIBER SLIVER, AND ROVING FRAME MACHINE

FIELD OF THE INVENTION

The present invention relates to a method for processing a strand-type fiber bundle, wherein the fiber bundle is supplied to an air-jet nozzle of a pre-spinning machine that serves to produce roving. A twist is imparted to the fiber bundle inside the air nozzle during normal operation of the air nozzle with the aid of a vortex air current, so that a roving is formed from the fiber bundle and wherein the roving finally leaves the air nozzle through an outlet in the air nozzle.

BACKGROUND

Pre-spinning machines having corresponding air nozzles are known in the prior art and are used to produce a roving from an elongated strand-type fiber bundle. The air nozzles usually, and preferably also with the air-jet spinning machine according to the present invention, include an interior vortex chamber as well as air jets opening into the vortex chamber, by means of which a vortex air current is created inside the vortex chamber during operation of the air-jet spinning machine. The outer fibers of the fiber bundle are wound around the interior core fibers due to the vortex air flow in the area of the inlet mouth of a yarn-forming element extending into the vortex chamber, thereby forming the winding fibers that are important for the desired strength of the roving. This yields a roving with a true twist, which is ultimately removed from the vortex chamber through a draw-off channel, finally leaving the air nozzle through an outlet.

The term roving (another name is sliver) is understood in general in the sense of the invention to refer to a fiber bundle in which at least some of the fibers are wound around an interior core. This type of yarn is characterized in that, despite having a certain strength sufficient to transport the yarn to a downstream textile machine, it is still capable of being drawn. Thus, the roving can be drawn with the aid of a drafting device, for example, a draw frame of a textile machine that processes roving, for example, a ring-spinning machine, before ultimately being spun to form a traditional yarn.

It is now customary in the state of the art for the roving leaving the air nozzle to be wound onto a sleeve thereby forming a bobbin (=sleeve wound with roving), which is ultimately transferred to the downstream textile machine. A corresponding pre-spinning machine is described in EP 2511403 A1, for example.

SUMMARY

An object of the present invention is to improve upon the known method with regard to the textile machines that are to be supplied with the roving and are being produced to run faster and faster. Additional objects and advantages of the invention will be set forth in part in the following description, or may be obvious from the description, or may be learned through practice of the invention.

The objects are achieved by a method and a pre-spinning machine having the features set forth herein.

According to the invention, the method for processing a strand-type fiber bundle is characterized in that the roving leaving the air nozzle is deposited in or on a receptacle made available in the area of the pre-spinning machine. In contrast with the known prior art, the roving is therefore not wound onto a sleeve to form a bobbin but instead it is deposited loosely in or on the receptacle, from which it can be removed and processed further after the receptacle has been transported to a downstream textile machine.

The receptacle is preferably a container, especially preferably a container that is open at the top, such as the type known from spinning mills and usually referred to as a spinning can. The spinning can is designed to be round or even elongated, e.g., rectangular, as seen from above. With regard to possible shapes, reference can be made to DE 10241011 A1 or DD 232246 A1, for example, where the shape of the container for the present invention tends to be of secondary importance. However, it is also conceivable for the receptacle to be designed merely as a flat section without side walls onto which the roving is deposited during deposition, for example, in the form of a pile. The receptacle may thus be in the form of a disk-shaped element, which can be transported with the roving to another textile machine after deposition of the roving.

The crucial factor is that the roving is not wound tightly onto a sleeve, as is customary, but instead is deposited in or on a receptacle so that it is no longer exposed to any tensile stress after being deposited. The receptacle is preferably designed as a container with a volume of at least 0.05 $m^3$, preferably at least 0.1 $m^3$. Since the amount of roving deposited in or on the receptacle corresponds to a multiple of the amount of roving that can be wound onto a sleeve, the roving deposited according to the invention can also be transferred to textile machines having a high consumption of roving. For example, suitably filled containers are an excellent model for a traditional air-jet spinning machine, on which each nozzle can produce several hundred meters of yarn per minute.

The roving is preferably deposited in or on the receptacle, so the roving has an average density of at least 0.14 $g/cm^3$, preferably at least 0.15 $g/cm^3$, especially preferably at least 0.16 $g/cm^3$ after the receptacle has been filled completely.

It is advantageous in particular if the roving is drawn off from the air nozzle by means of a draw-off device. The draw-off device may include, for example, two corresponding draw-off rollers driven with the aid of a drive, the roving being guided between them, clamped after leaving the nozzle and directed toward the receptacle. After passing the draw-off device, the roving finally reaches the area of a deposition device, which grips and deposits it in or on the receptacle. The deposition device here ensures that the roving goes into or onto the receptacle in a defined and controlled manner, thereby preventing knots and undefined overlapping of the roving, which would be unfavorable for subsequent removal of the roving from the receptacle. The roving is preferably deposited in or on the receptacle in the form of a loop with the aid of the draw-off device, the loops optionally having a circular or oval shape in at least some sections.

The deposition device preferably includes a deposition plate with a deposition channel through which the roving is directed during deposition, wherein the deposition plate is induced to rotational movement preferably with the aid of a drive during the deposition of the roving.

Additionally or alternatively, a rotary plate, on which the receptacle is situated during deposition and which is driven by a drive during the deposition of the roving, may also be present (wherein the drive may be the same drive that also drives the deposition plate, so that the two plates can be driven in synchronization).

Although a rotational motion of the deposition plate and/or rotary plate is possible, the deposition plate and/or rotary plate may also be driven with the aid of a drive, which induces a non-rotational movement of the corresponding rotary plate and/or the deposition plate. For example, instead of the rotary plate, some other moving element may be provided, on which the receptacle is placed or otherwise held during the deposition of the roving, and which is moved along a path of movement consisting of or comprising individual linear or curved segments to prevent unwanted twisting of the roving about its longitudinal axis during the deposition. The receptacle can be moved in a partially or completely translatory fashion in particular.

Furthermore, it is conceivable for the receptacle to be rotated ultimately in a first direction and a second opposite direction. For example, the receptacle may be rotated alternately by 360° clockwise and then by the same amount counterclockwise to prevent unwanted twisting of the deposited roving. Likewise, two deposition plates that deposit the roving from two air nozzles arranged side by side in or on a joint receptacle may be used. In this case, the deposition plates may also rotate alternately in opposite directions of rotation, wherein an angular range of 180° would be advantageous here.

There are also advantages if the roving is gripped by the deposition device immediately after passing through the draw-off device and is deposited in or on the receptacle. In this case, no additional elements that could guide the roving by direct contact are provided between the draw-off device and the deposition devices. One or more sensors that monitor the roving for its quality (thickness, hairiness, etc.) or monitor whether roving is coming out of the air nozzle at all and/or entering the area of the deposition device or they monitor the course of the roving may of course be arranged between the draw-off device and the deposition device.

It is also possible for the roving to form a curtain between the draw-off device and the deposition device such that its vertical spatial extent is regulated on the basis of the deposition rate of the deposition device. The roving thus describes a parabola, for example, between the air nozzle and/or the draw-off device and the deposition device and/or a guide upstream therefrom (e.g., a guide roller). The deposition rate is increased if the vertical spatial extent reaches or exceeds a predetermined maximum value. If the vertical spatial extent is less than or equal to a predetermined minimum, then the deposition rate is reduced, so that the rate of deposition is increased or reduced by changing the rotational speed of the deposition plate and/or the rotary plate, and wherein the change is preferably performed automatically by controlling the pre-spinning machine.

Finally, it is also conceivable for the roving to be guided over a guide between the draw-off device and the deposition device. The guide may be designed as a conveyor belt or as an elongated channel, for example, wherein one or more jets connected to a compressed air supply in order to guide the roving with the aid of compressed air in the direction of the deposition device or to be able to move it through the guide may be provided. The jets may also serve as threading aids by means of the air flow coming from them in order to move the roving into or onto the guide after leaving the draw-off device and/or the air nozzle.

Normal operation of the pre-spinning machine (during which roving is produced and deposited in or on the receptacle) is usually interrupted by stop phases during which no roving is being produced by the air nozzle. The reason for this could be, for example, a tear in the roving, a problem with the fiber bundle feed or blockage of the air nozzle. It is preferably provided that the system goes through a starting phase between such a stop phase and normal operation subsequently.

The start-up phase is characterized in that production of roving is resumed, wherein the roving produced by the air nozzle is at least temporarily not deposited in or on the receptacle after leaving the air nozzle but instead is discarded through a roving discharge. The roving waste may be, for example, a suction element (e.g., a suction pipe) that is under a vacuum. In any case it is advantageous if an initial section of the roving produced on resumption of roving production does not get on or in the receptacle because the quality of the initial section would not usually meet specifications. If a certain quantity/length of roving were removed during the start-up phase, the roving discharge could be deactivated or bypassed (for example, by a shunt, which has an influence on the tracking of the roving), so that the roving then produced ends up in or on the receptacle, such that the roving that goes in or on the receptacle is separated from the portion of roving discharged (to prevent it from ultimately getting into or onto the receptacle).

It is particularly advantageous if a receptacle replacement operation is carried out when the receptacle has reached a defined degree of filling or when a defined amount or length of roving has been produced by the air nozzle and deposited in or on the receptacle. The amount or length of roving and/or the aforementioned degree of filling can be monitored with the aid of one or more sensors. In any case, after reaching the corresponding target values, the receptacle being filled until this point in time is replaced by an empty receptacle. The replacement operation here can be carried out automatically with the aid of a receptacle changing device of the pre-spinning machine or manually by an operator.

It is also advantageous if production of the roving is not stopped during the receptacle replacement operation. In other words, production of roving by the air nozzle should continue during the receptacle replacement operation. The roving thus produced is then deposited in or on a first receptacle before the receptacle replacement operation. Finally, the deposition of roving in or on the second receptacle takes place during or after the receptacle replacement operation, wherein the corresponding receptacles are shifted (for example, by means of the receptacle replacement device referenced above) beneath the air nozzle, which always remains in the same location. A roving loop present between the two receptacles after the receptacle replacement operation must ultimately be severed to be able to remove the full receptacle independently of the filling of the new receptacle by the pre-spinning machine.

It is particularly advantageous if the roving produced by the air nozzle during the receptacle replacement operation is discarded via a roving discharge mechanism in at least some portions. Thus, the roving is produced continuously during the receptacle replacement operation, then going into or onto a first receptacle before the receptacle replacement operation and into or onto a second receptacle after or even during the receptacle replacement operation. In the meantime, the roving leaving the air nozzle is discharged via the roving discharge wherein the portion of roving in or on the first receptacle is first severed. After the end of the discharge process, the roving leaving the air nozzle is finally sent again to the deposition device, which deposits the roving in or on the second receptacle referenced above. The amount of roving produced per by the air nozzle per unit of time during the receptacle replacement operation and/or during the time in which the roving is discarded via the roving discharge is throttled at least temporarily in comparison with normal operation in order to minimize the amount of roving discarded.

It is also advantageous if production of the roving is interrupted temporarily before or during the receptacle replacement operation. This can take place either by stopping the supply of fiber bundle to the air nozzle or interrupting the air supply to same. In any case, this involves stopping the production of roving. If the receptacle that was previously filled is replaced by an empty receptacle, it is possible to continue with the production of roving, wherein it is advantageous in principle if the deposition device is already put in motion, e.g., in rotation before the roving reaches the deposition device.

It is also conceivable to begin again with the production of roving even during the replacement of the aforementioned receptacles and to discharge the initial portion of the roving then produced via the roving discharge for a certain period of time before roving is again deposited in or on the initially empty receptacle. It is thus particularly advantageous if, after the interruption in roving production, there is a start-up phase, during which the roving produced by the air nozzle is at least temporarily not deposited in or on the receptacle after leaving the air nozzle but instead is discarded via the roving discharge.

It is particularly advantageous if the receptacle is moved after being filled partially or completely with roving to an air-jet spinning machine, which is used for production of traditional yarn, wherein the roving present in or on the receptacle is then spun to a yarn with the aid of the air-jet spinning machine. The filled receptacle thus serves as a recipient for the air-jet spinning machine, which also produces a traditional yarn from the roving with the aid of a vortex air current, this traditional yarn ultimately being suitable for processing to fabric with the aid of a weaving machine. Corresponding air-jet spinning machines are sufficiently familiar in the state of the art and usually comprise a plurality of nozzles, each with a draw frame for drawing the roving, a downstream air nozzle, to impart the desired twist and thus to produce the yarn as well as a bobbin unit for the yarn leaving the air nozzle to be wound onto.

It is also advantageous if the receptacle is moved to a spinning/knitting machine which is used to produce a knit after the receptacle has been filled partially or completely with roving, wherein a knit is produced from the roving present in or on the receptacle with the aid of the spinning/knitting machine. A spinning/knitting machine usually also includes a draw frame for drawing the roving. Furthermore, a twist unit is also provided to impart a slight twist to the drawn roving so that it can be conveyed to a knitting unit of the spinning/knitting machine. The knitting unit ultimately processes the drum roving to form a knit fabric. The knitting unit of the spinning/knitting machine may be located in general a few centimeters to several meters away from the twist unit. If this distance is greater than a maximum value determined previously, it may be advantageous to furnish the material with one or more filaments, wherein the filament can be introduced into the flow of material in the region of the draw frame or the twist unit to thereby form a type of core yarn.

Ultimately the pre-spinning machine according to the invention is characterized in that it comprises at least one deposition device, with the aid of which the roving leaving the air nozzle, preferably in the form of a loop, can be deposited in or on a receptacle. Furthermore, individual ones or all of the physical features discussed above or below, for example, the draw-off device, can be implemented.

It is also extremely advantageous if the pre-spinning machine comprises or is connected to a controller designed to operate the pre-spinning machine according to the description above or hereinafter.

BRIEF DESCRIPTION OF THE DRAWINGS

Additional advantages of the invention are described in the following embodiments, in which each shows schematically.

DETAILED DESCRIPTION

Figure 1:
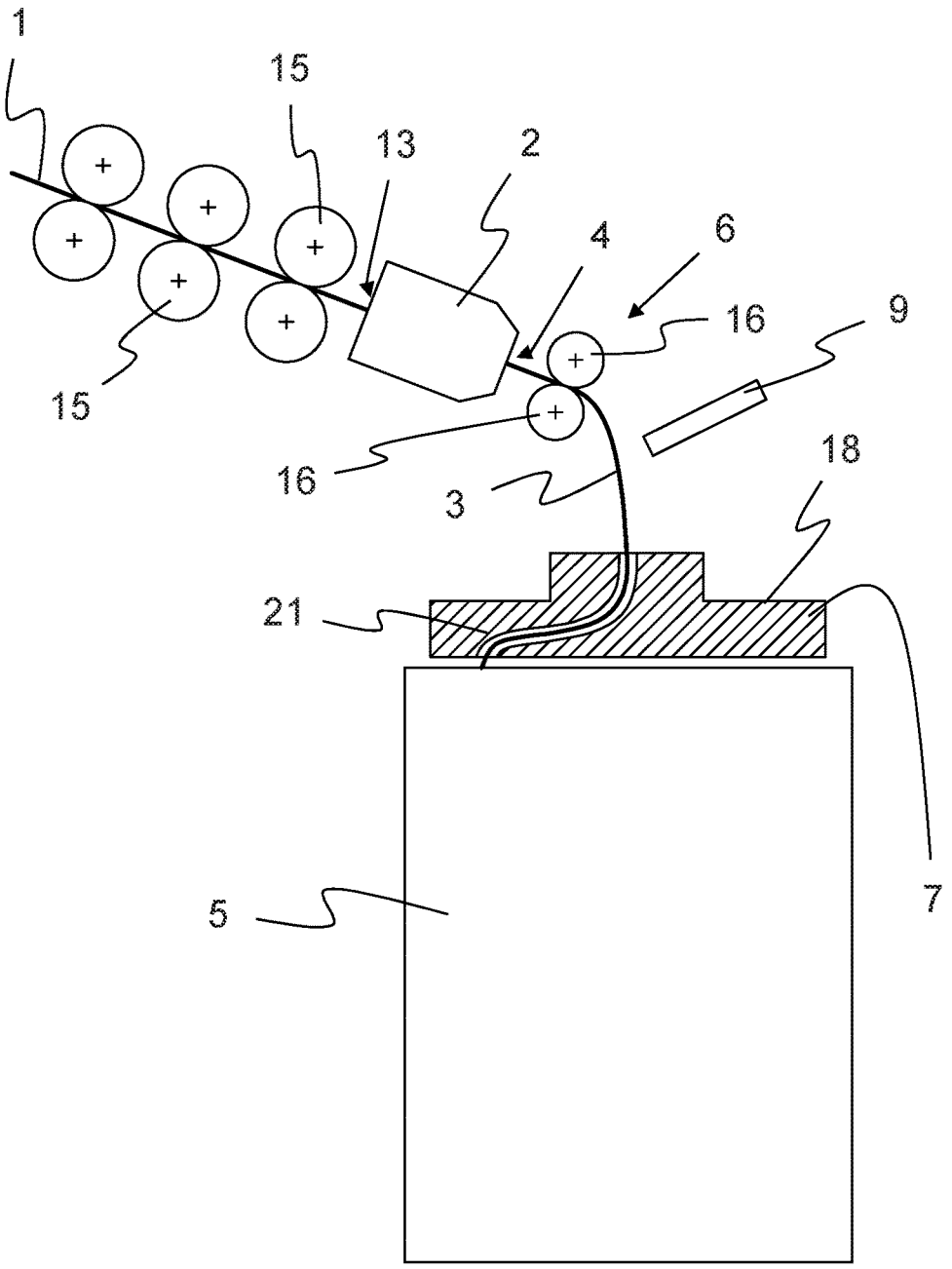
FIG. 1 shows selected elements of a pre-spinning machine according to the invention in a side view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a pre-spinning machine according to the invention (wherein only selected elements, which are relevant for an understanding of the invention, are shown; the same thing is also true of the remaining figures).

The pre-spinning machine may comprise, if needed, a draw frame having a plurality of draw frame rollers 15, each of which can rotate about an axis of rotation (only two of the six draw frame rollers 15 are labeled with a reference numeral), wherein the draw frame is supplied with a fiber bundle 1, for example, in the form of a double draw frame sliver during spinning operation.

Figure 2:
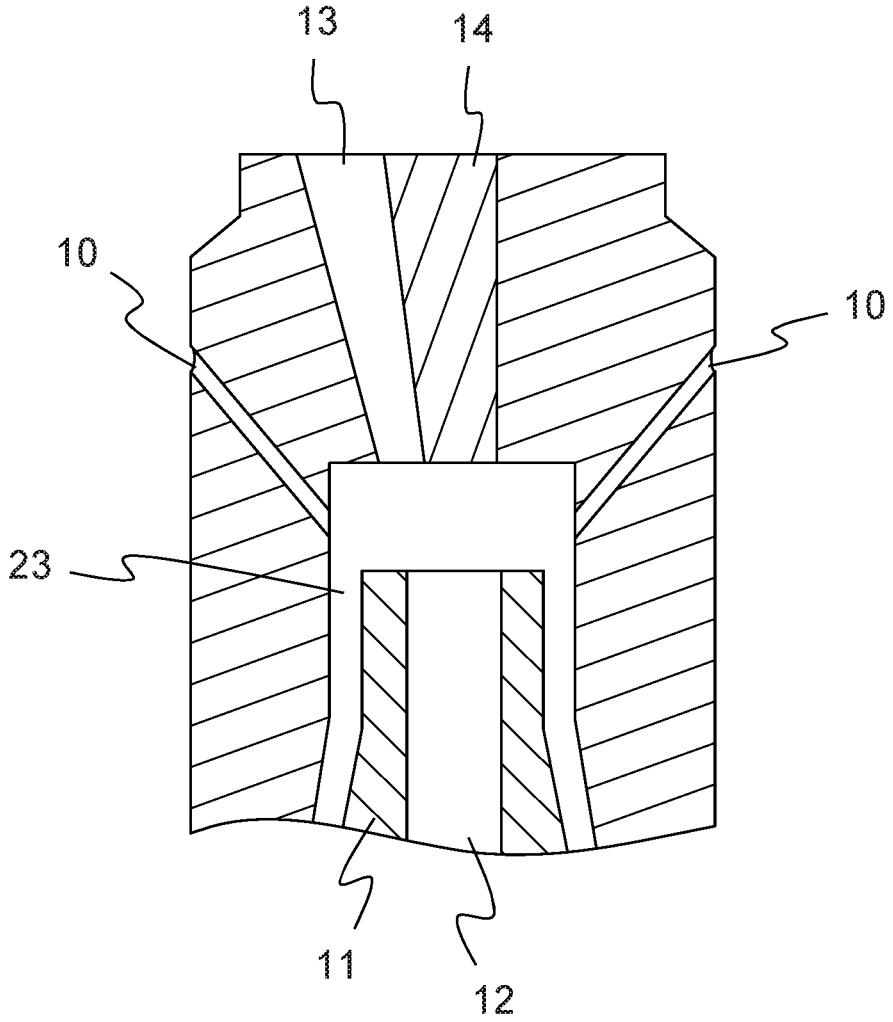
FIG. 2 shows a sectional diagram of a detail of an air nozzle of a pre-spinning machine according to the invention.

Furthermore, the pre-spinning machine shown here comprises one or more air nozzles 2 arranged in proximity to one another, each with an interior vortex chamber 23 (see FIG. 2), in which the fiber bundle 1 and/or at least a portion of the fibers of the fiber bundle 1 is provided with a twist (the exact mechanism of action of the nozzle is described in greater detail below).

Figure 3:
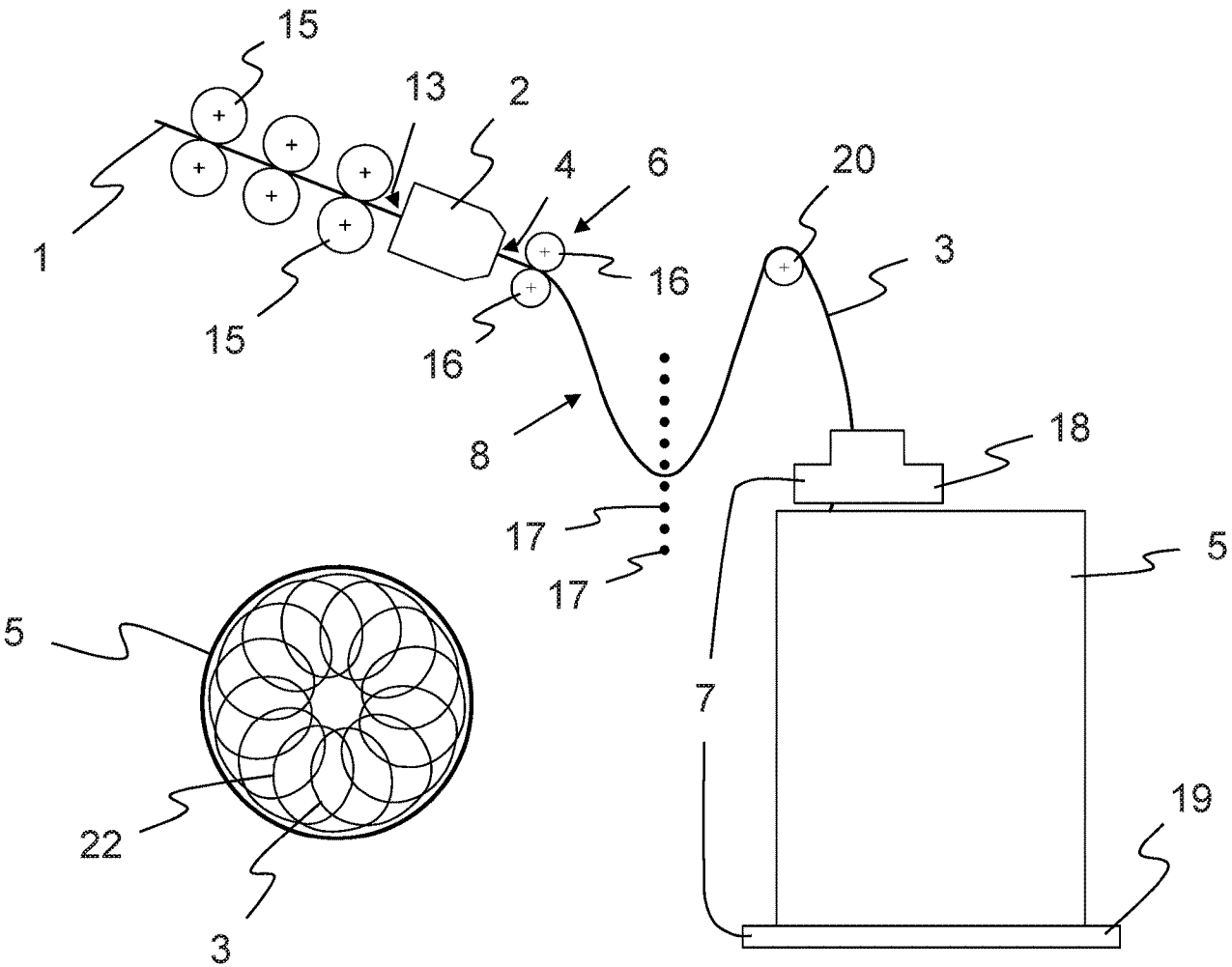
FIG. 3 shows selected elements of another pre-spinning machine according to the invention in a side view as well as a top view of a receptacle designed as a container, including the roving.

In addition, the pre-spinning machine may comprise a draw-off device 6, preferably having a plurality of cooperating draw-off rollers 16 with the aid of which the roving 3 leaving the nozzle through its outlet 4 is captured and guided (the draw-off rollers 16 can preferably be made to rotate with the aid of a drive, not shown here). The pre-spinning machine according to the invention need not necessarily include a draw frame, as illustrated in FIGS. 1 and 3. The draw-off rollers 16 are also not absolutely necessary.

In any case, the pre-spinning machine according to the invention operates downstream from an air-jet spinning process. To form the roving 3, the fiber bundle 1 is fed into the vortex chamber 23 of the air nozzle 2 via an inlet 13 to the air nozzle 2, in which a so-called fiber guide element 14 is preferably situated (see also FIG. 2). In the vortex chamber, the fiber bundle receives a twist, i.e., at least a portion of the free fiber ends of the fiber bundle 1 is captured by an air stream created by air jets 10 arranged accordingly in a vortex chamber wall surrounding the vortex chamber 23. Some of the fibers are pulled at least a certain distance out of the fiber bundle 1 in this way and wound around the tip of a yarn-forming element 11 protruding into the vortex chamber 23. Due to the fact that the fiber bundle 1 is drawn out of the vortex chamber 23 by means of a draw-off channel 12 arranged inside the yarn-forming element 11, ultimately the free fiber ends are also drawn in the direction of the yarn-forming element 11 and, in doing so, are wrapped as so-called winding fibers around the core fibers running centrally, resulting in a roving 3 with the desired twist.

In general, it should be pointed out here that the roving 3 that is produced is a roving with a relatively small amount of winding fibers and/or a yarn in which the winding fibers are wound relatively loosely around the inner core so that the roving 3 remains drawable. This is crucial because the roving 3 produced in this way must then be drawn again with the aid of a draw frame on a downstream textile machine (for example, a traditional air-jet spinning machine) to enable it to be processed to form a traditional yarn, which can be processed on a weaving machine to form a fabric, for example.

The basic idea of the present invention can now be explained with regard to FIGS. 1 and 3. It was previously customary to wind roving 3 onto a sleeve, regardless of whether it was produced on a traditional flyer or an air pre-spinning machine.

In contrast with that procedure, the present invention now proposes that the roving 3 can be deposited loosely in a receptacle 5 designed as a container after leaving the air nozzle 2, wherein the spinning cans, which are known to be used in spinning mills, can preferably be used here.

As can be seen in FIG. 1, among others, it is advantageous that the pre-spinning machine has a deposition device 7 for this purpose, including at least one deposition plate 18.

The deposition plate 18 can be induced to rotate with the aid of a drive (not shown) in order to be able to deposit the roving 3 coming from the air nozzle 2 in the form of loops in the receptacle 5.

Alternatively or additionally, the deposition device 7 may also have a rotating plate 19 which is shown in FIG. 3, and with the aid of which the receptacle 5 can be made to rotate.

If both the rotating plate 19 and the deposition plate 18 (which in the case of FIG. 3 is arranged with an offset from the central axis of the receptacle 5) are induced to rotate, the result is the deposition pattern of the roving 3 and/or the loops 22 shown at the lower left of FIG. 3 (FIG. 3 thus shows a detail of a pre-spinning machine and also a receptacle 5, which is partially filled with roving 3 from above; this of course does not reflect the actual position of the receptacle 5 with respect to the pre-spinning machine).

As also shown by a comparison of FIGS. 1 and 3, after leaving the draw-off device 6, the roving 3 can be sent directly either to the deposition plate 18 or to its interior deposition channel 21, which runs in a helical pattern (FIG. 1). However, it is also conceivable for the roving 3 to first form a curtain 8 and then to be sent to the deposition plate 18, wherein one or more sensors 17 and/or an additional guide 20, e.g., in the form of a guide roller, may be present between the deposition plate 18 and the draw-off device 6. The sensor(s) 17 monitor the vertical extent of the curtain 8, wherein one controller (not shown) regulates the rotational speed of the rotating plate 19 and/or of the deposition plate 18 on the basis of the measured values from the sensor(s) 17, as described above, in order to keep the vertical extent within a defined range.

Finally, FIG. 1 shows that it may be advantageous if the pre-spinning machine has a roving discharge 9, for example, in the form of a suction pipe. If roving production is begun now, there is first a start-up phase, during which the roving 3 leaving the air nozzle 2 is captured by the roving discharge 9 and discarded. If the quality of the roving 3 ultimately meets the specifications, the roving discharge 9 can be deactivated, wherein the portion of roving already discharged via the roving discharge 9 is separated from the roving portion now being produced by the air nozzle 2 via means not shown here (e.g., a cutting unit). Finally, the beginning of this portion is sent to the deposition device 7 and deposited in the receptacle 5, wherein the transfer of the roving portion produced last to the deposition device 7 can take place with the aid of a blow nozzle or mechanical means, for example. The function of the blow nozzle can also be taken over by the roving discharge 9 if the blow nozzle is exposed to an excess pressure instead of a vacuum.

Reference is made to the preceding discussion with regard to possible receptacle replacement operations.

The present invention is not limited to the embodiments illustrated and described here. Modifications within the scope of the patent claims are also possible as is any combination of the features described here even if they are illustrated and described in different parts of the description and/or claims or in different embodiments, assuming that the modifications are not in contradiction with the requirements of the independent claims.

LIST OF REFERENCE NUMERALS

1 fiber bundle
2 air nozzle
3 roving
4 outlet
5 receptacle
6 draw-off device
7 deposition device
8 curtain
9 roving discharge
10 air jet
11 yarn-forming element
12 draw-off channel
13 inlet
14 fiber guide element
15 draw frame roller
16 draw-off roller
17 sensor
18 deposition plate
19 rotary plate
20 guide deposition
21 channel
22 loop
23 vortex chamber

The invention claimed is:

1. A method for processing a strand-type fiber bundle, comprising:

sending the strand-type fiber bundle to an air nozzle of a pre-spinning machine used to produce roving;

during normal operation, imparting a twist to the strand-type fiber bundle via a vortex air current within the air nozzle to form the roving from the strand-type fiber bundle, wherein the roving leaves the air nozzle through an outlet in the air nozzle;

from the outlet, depositing the roving in or on a receptacle;

interrupting the normal operation in a stop phases during which roving is not produced by the air nozzle;

performing a start-up phase between the stop phase and subsequent normal operation wherein the roving produced during the stop phase is discarded via a roving discharge after leaving the air nozzle when quality of the roving does not meet a desired specification; and deactivating the roving discharge when the quality of the roving meets the desired specification and separating the roving removed by the roving discharge.

2. The method according to claim 1, wherein the roving is drawn off from the air nozzle with a draw-off device and is deposited in a form of a loop in or on the receptacle.

3. The method according to claim 2, wherein the roving is captured by a deposition device after passing through the draw-off device and is deposited in or on the receptacle device via the deposition device.

4. The method according to claim 3, wherein the roving forms a curtain between the draw-off device and the deposition device, and wherein a vertical and spatial extent of the curtain is regulated by a deposition rate of the deposition device.

5. The method according to claim 1, wherein a receptacle replacement operation is carried out when the receptacle has reached a defined level of filling or when a defined quantity of roving or length of roving has been produced by the air nozzle and deposited in or on the receptacle.

6. The method according to claim 5, wherein production of the roving is not stopped during the receptacle replacement operation.

7. The method according to claim 6, wherein the roving produced by the air nozzle during the receptacle replacement operation is discarded at least in some sections by a roving discharge mechanism.

8. The method according to claim 5, wherein production of the roving is interrupted temporarily during the receptacle replacement operation.

9. The method according to claim 8, wherein after the interruption in the roving production process, the start-up phase is performed.

10. The method according to claim 1, wherein the receptacle is moved to an air-jet spinning machine that is used to produce yarn after being partially or completely filled with the roving.

11. The method according to claim 1, wherein the receptacle is moved to a spinning/knitting machine that is used to produce a knit fabric after being partially or completely filled with the roving.

12. A pre-spinning machine for producing a roving from a strand-type fiber bundle, comprising:

an air nozzle comprising air jets configured to impart a twist to the strand-type fiber bundle via a vortex air current to produce a roving from the strand-type fiber bundle;

an outlet in the air nozzle through which the roving leaves the air nozzle during normal operation of the pre-spinning machine;

a deposition device disposed downstream of the air nozzle and configured to deposit the roving into or on a receptacle; and wherein the pre-spinning machine is configured to operate in accordance with the method of claim 1.

* * * * *